United States Patent [19]

Paturel et al.

[11] Patent Number: 5,012,099

[45] Date of Patent: Apr. 30, 1991

[54] INTRUSION DETECTION AND IDENTIFICATION ARRANGEMENT FOR LAND VEHICLES

[75] Inventors: Serge Paturel, Orsay; Francois Magne, Paris, both of France

[73] Assignee: U.S. Philips Corp., New York, N.Y.

[21] Appl. No.: 519,351

[22] Filed: May 1, 1990

Related U.S. Application Data

[63] Continuation of Ser. No. 355,094, May 18, 1989, which is a continuation of Ser. No. 136,250, Dec. 18, 1987, both abandoned.

[30] Foreign Application Priority Data

Dec. 23, 1986 [FR] France ..... 86 18050

[51] Int. Cl.[5] ..... G08G 1/17

[52] U.S. Cl. ..... 250/342; 250/349

[58] Field of Search ..... 250/342, 349, 358.1, 250/359.1, 360.1, 339; 246/169 D

[56] References Cited

U.S. PATENT DOCUMENTS

| | | | |
|---|---|---|---|
| 3,646,343 | 2/1972 | Caulier et al. | 246/169 D |
| 4,155,007 | 5/1979 | Beckmann | 250/342 |
| 4,300,824 | 11/1981 | Tokuda et al. | 354/403 |
| 4,323,211 | 4/1982 | Bambara et al. | 246/169 D |
| 4,348,898 | 9/1982 | Stan | 250/358.1 |
| 4,479,056 | 10/1984 | Zierhut | 250/342 |
| 4,612,442 | 9/1986 | Toshimichi | 250/349 |
| 4,849,635 | 7/1989 | Sugimoto | 250/342 |

FOREIGN PATENT DOCUMENTS

| | | | |
|---|---|---|---|
| 0585176 | 10/1959 | Canada | 250/342 |
| 0065159 | 11/1982 | European Pat. Off. . | |
| 2107453 | 4/1983 | United Kingdom | 250/342 |
| 2129639 | 5/1984 | United Kingdom . | |

*Primary Examiner*—Constantine Hannaher
*Attorney, Agent, or Firm*—William L. Botjer

[57] ABSTRACT

The arrangement (201) comprises an optical narrow detection beam (203) focussing system for a passive infrared radiation in accordance with a reference plane (U). A filter selects the spectral analysis band and at least one passive infrared radiation detector is provided in the focal plane. According to the invention, the arrangement comprises a first analog processing chain and a second digital processing chain by means of which it is possible to recover in accordance with a characteristic curve at least the undercarriage of vehicles. On this curve, each turning element of the undercarriage assumes the shape of an identifiable pulse. The arrangement is used in the identification of moving vehicles in a predetermined plane.

4 Claims, 2 Drawing Sheets

INTRUSION DETECTION AND IDENTIFICATION ARRANGEMENT FOR LAND VEHICLES

This is a continuation of application Ser. No. 355,094, filed May 18, 1989 which is a continuation of Ser. No. 136,250, filed Dec. 18, 1987, both now abandoned.

BACKGROUND OF THE INVENTION

The invention relates to an arrangement for detecting the intrusion of and identifying land vehicles when these land vehicles pass a reference plane, comprising an optical system for focussing a narrow detection beam for detecting a passive infrared radiation in said reference plane, a filter allowing the selection of the spectral analysis band and at least one detector arranged in the focal plane of said optical system.

This arrangement is suitable for civil or military uses. It is more specifically designed to identify the general shapes of mobile vehicles, in particular the proportion between some of their characteristic elements and not their speed or the direction in which they move. It is, for example, used to recognize the type of vehicles which enter or leave a parking-lot or vehicles which usually do not drive on given roads or within the precincts of a factory etc. The use for military purposes consists in the arrangement being used, in association with further pick-up devices or sensors, in the processing of an automatic light switch-on command for an anti-tank trap. The principle of detecting objects, persons or vehicles by means of passive infrared radiation detectors, more specifically piezo-electric detectors, is known and is used, for example, to trigger automatically the opening of doors when a passive infrared radiation (IR-P) is transmitted by the object in a narrow detection beam. The European Pat. 0 065 159 in particular discloses a movement detector for monitoring a space which utilizes the infrared thermal radiation of a non-authorized person entering the space and in which the radiation receiver is a piezo electric element. Passive infrared detectors (IR-P) are increasingly preferred to Doppler radar arrangements, which are much more susceptible to false alarms and which can be detected by the electromagnetic radiation they transmit, the latter constituting a drawback for military uses. The pyro-electric detectors are simple to use because of the facts that they do not require any cooling, and are suitable for a detection in a range of some dozens of metres at a maximum, beyond which the thermal noise of the detectors becomes predominant with respect to the useful signal searched for. The foregoing relates to a simple detection which does not furnish any other information than the presence or absence of a warm object in a detection beam. On the other hand, infrared thermographical systems are known which by means of a thermal camera and a television monitor render it possible to obtain an image from the passive infrared radiation in a field of vision which may be at a distance of several kilometers and in accordance with several dozens of contrast levels. Such systems which however always require cooling of the detectors, are complicated and expensive.

SUMMARY OF THE INVENTION

The invention has for its object to effect, by means of passive infrared detectors the identification of certain mobile vehicles by means of a simplified thermal imaging device.

This object is accomplished thanks to the fact that the intrusion detection and vehicle identifying arrangement defined in the opening paragraph, is characterized in that each detector is followed by a first chain for the analog processing of the amplified and filtered signal and that it additionally comprises subsequent to said first chain a second digital signal processing chain comprising sample-and-hold means and processing the samples such that at least the undercarriage of said vehicle is covered by said signal processing means in the form of a curve as a function of time in accordance with which each turning element of the undercarriage assumes the shape of an identifiable characteristic pulse.

The invention utilizes the fact that the turning elements of the undercarriage of a vehicle have the properties of heating up by friction and/or elastic deformation during moving of this vehicle.

The speed of the vehicle or the angle at which it shows itself relative to the reference plane has an influence on the time required by the vehicle to cross the reference plane, that is to say on the scale of the abscissa of the curve. However, the ratios between the relative deviations between the different characteristic pulses of the curve are preserved under these conditions. These ratios are above all representative of the shape of a particular vehicle, in combination with its bulk, which enables the desired identification.

Moreover the azimuthal resolution of the detection beam is physically limited to a minimum value such that it might prove insufficient for very small vehicles, so that it is possible to omit the latter vehicles and also persons from the class of vehicles to be identified. In this respect an advantageous embodiment of the arrangement is characterized in that at the maximum anticipated observation distance and for all the anticipated angles at which said vehicles present themselves relative to said reference plane, the azimuthal aperture beam of said passive infrared radiation beam is such that the distance between two adjacent turning elements of the undercarriage is resolved by each detector.

For a surveillance zone of such a large dimension, the arrangement of the invention must be designed to function in a range window comprised between some metres and some dozens of metres; in these conditions an advantageous embodiment is characterized in that it comprises a plurality of n pyro-electric detectors which are arranged vertically and adjacent to each other in such a manner as to define in the reference plane n adjacent detection sub-beams having respective sight angles $\theta_{s/n}$ of the order of some degrees, the sight angle $\theta_s$ of said beam being taken in a direction towards the ground from a horizontal line of the reference plane situated at a height of approximately 1 m.

Depending on the distance of the vehicle when it passes through the reference plane, its undercarriage is detected in one or several detection sub-beams, which renders it possible to simultaneously detect the overall undercarriage and also to obtain an indication of the distance to the vehicle.

BRIEF DESCRIPTION OF THE DRAWINGS

The following description which is given by way of example with reference to the accompanying drawing will make it better understood how the invention can be put into effect.

DESCRIPTION OF THE PREFERRED EMBODIMENT

Figure 1:
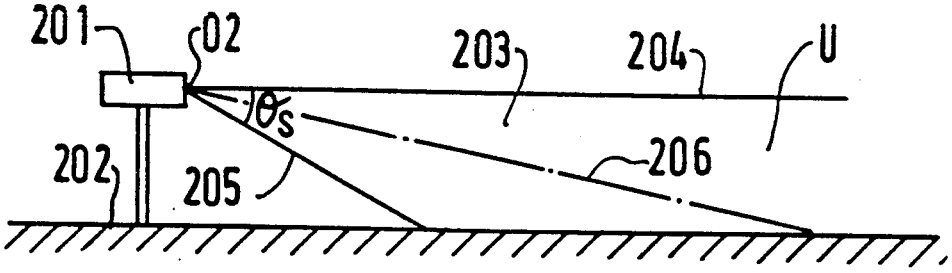
FIG. 1 is a schematic side view of the arrangement according to the invention installed in a predetermined site.
Figure 2A:
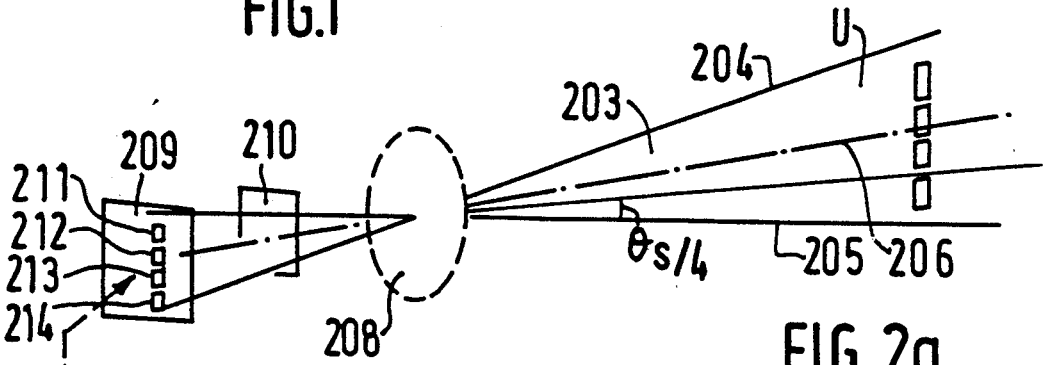
FIG. 2*a* illustrates a structural arrangement which renders it possible to put the detection in the passive infrared technique according to the invention into effect.

FIG. 1 shows a detection and surveillance arrangement according to the invention. This arrangement is mounted, in a fixed position, in a site 202 and, as is shown in FIG. 2*a* comprises an optical system by means of which it is possible to focus at at least one detector a narrow detection beam for detecting a passive infrared radiation (IR-P). In a transversal view the detection beam 203 originates from a point 02 situated at a height of approximately 1 m; its angle of sight $\theta_s$ of the order of one to several dozens of degrees is limited by a substantially horizontal line 204 and a downwardly directed oblique line 205 and the symmetry axis 206 of the beam 203 is an oblique line which meets the ground between some metres and some dozens of meters. The azimuthal angle $\theta_g$, not shown is of the order of one to some tenths of degrees.

Figure 2B:
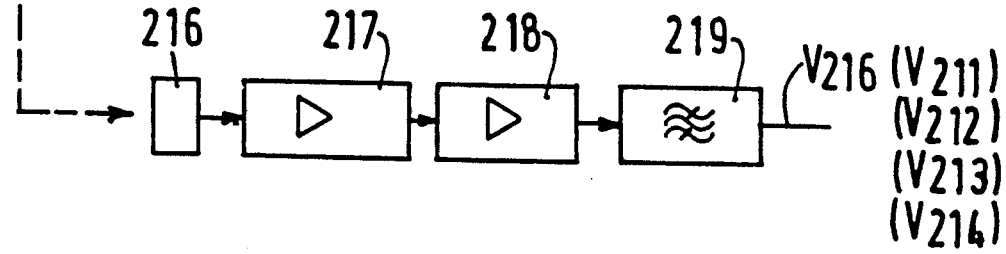
FIG. 2*b* is a block diagram of the first analog processing chain.

The following is a description given with reference to FIGS. 2*a* and 2*b* of the intrusion detection system in which the detection is effected by the passive infrared sensor which comprises the device 201. The beam 203 is obtained from the following elements:

an optical system 208 which is characterized by its focal length f, its aperture and its optical axis 206, a network of detectors IR-P 209 provided in the focal plane of the optical system 208, which is constituted by an array of infrared detectors 211, 212, 213, 214, which are sensitive to the radiation used in the infrared analysis band whose dimensions and also the relative arrangements combined with the distance f of the optical system 208 provides the field of analysis constituted by the detection beam 203. In this respect it should be noted that it is possible to utilize one sole detector at 209. The detectors are preferably pyro-electric detectors which are sensitive to radiation in the electro-magnetic band comprised between a wavelength 1 μm and 15 μm. Suitable detectors are, for example, the detectors RPY94 or RPY98, whose dimensions are approximately 1 mm×2 mm, manufactured by the English Firm of Mullard. The spectral analysing band, for example between 3 μm and 14 μm, preferably between 8 and 12 μm can be selected by means of a filter 210.

It should be noted that the beam 203 whose solid analysing angle is $\theta_s \cdot \theta_g$ is formed in the example shown in FIG. 2*a* by n contiguous sub-beams in a vertical reference plane U which comprises the axis 206, the azimuthal beam aperture: $\theta_g$, and the angle of sight aperture $\theta_{s/n}$, n being equal to 4 in the example chosen.

Each detector of the network 209 is followed by an analog signal processing chain shown in FIG. 2*b*. This chain comprises, arranged in cascade, the detector 216, which represents one of the detectors 211, 212, 213 or 214, a preamplifier 217, an amplifier 218 and a bandpass filter 219. The filter 219 supplies the voltage $V_{216}$ ($V_{211}$, $V_{212}$, $V_{213}$ or $V_{214}$). The overall passband of this processing chain is comprises between some tenths of Hz, typically 0.5 Hz, to render it insensitive to the d.c. component, and some dozens of Hz (typically 50 Hz), which corresponds to the maximum modulation frequency necessary to take account of the vehicles likely to cross the reference plane U. The assembly constituted by the optical system 208, the filter 210, the detector 216 and its amplifying and filtering chain has a noise-equivalent temperature difference (NETD) less than 1K.

The simplified infrared analysis which is the object of and is realised by the invention is to obtain, by day as well as by night, a certain number of particulars of one (or several) vehicle(s) which have crossed the detection beam 203, either to identify them or to class them or not class them in the category of objects to be destroyed when it is utilised for military purposes. In the latter case this analysis is obtained after certain tests as regards the distance at which the vehicle passes and its speed have been performed with success.

The criteria which are taken into consideration when designing the device 201 are the following:

the vehicles present in the approaches to the device will be mobile and will only seldom face the arrangement. The beam or the contiguous sub-beams, 203, although they are fixed, use with advantage the movement of the vehicles to effect the analysis lengthwise along their flanks.

The vehicles reaching the reference plane U will have driven for a long time, which will have raised the temperature of their undercarriage, both in the case of vehicles having tracks or those having tires.

The position of the device 201 very close to the soil is such that the lower portion of the body of the vehicle will remain in the beam 203 all the time it passes it, independent of the value of the angle $\epsilon$ between the path of the vehicle and the plane U, the angle $\epsilon$ being assumed to be comprised between 45° and 135°.

The detectors detecting the beams to a be analysed will not be sensitive to the d.c. components, which has several consequences: on the one hand the infrared phenomena which develop very slowly in the environment such as, for example those produced by the sun, are disturbing. On the other hand the constant-temperature zones on the vehicles will not produce any signal, only the transitions are counted. The undercarriage of the vehicle is a characteristic attribute of the transitions.

Figure 3:
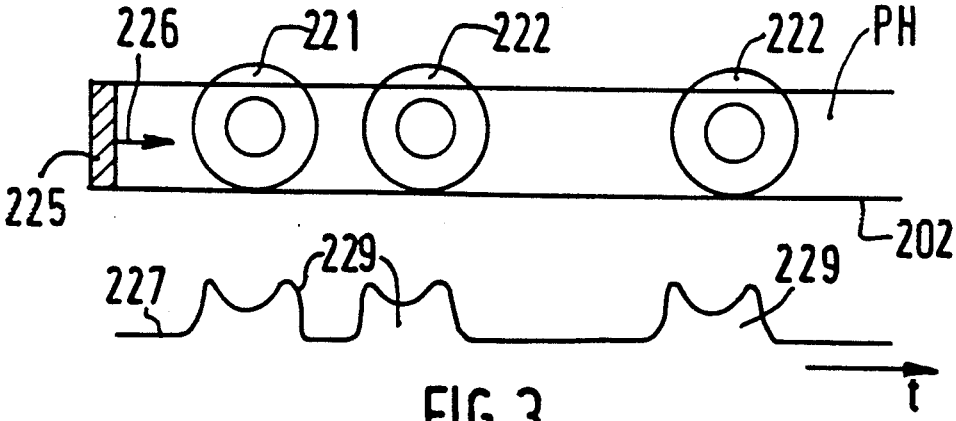
FIG. 3 shows the curve obtained for a vehicle with tyres.

When a vehicle with tyres is concerned, see FIG. 3, the tires 221, 222 are heated by friction and deformation. These tires (typically three for a truck) are rarely built-in, as at the front part (221) the wheels dictate the direction and the required lateral tolerance is the reason that it is not possible to integrate them completely behind the body, and at the rear (222) they are not covered to enable easy access.

Figure 4:
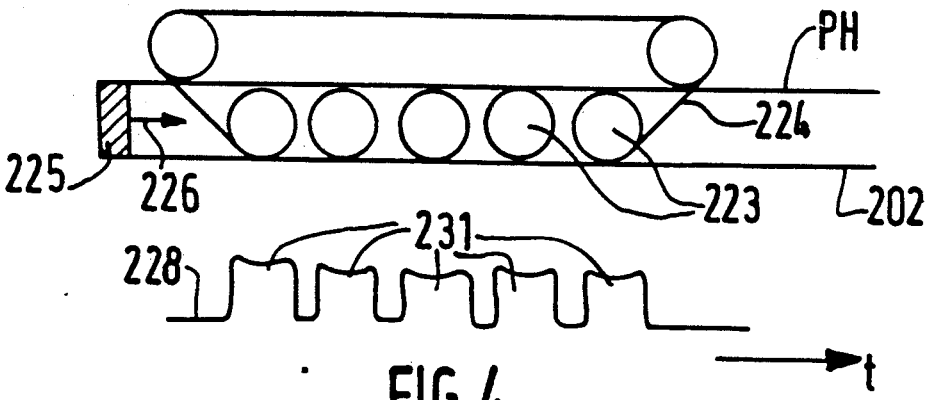
FIG. 4 shows the curve obtained for a vehicle having tracks.

For a vehicle having tracks, FIG. 4, the low part of the body is formed by a number of rollers 223, generally more than six. Friction is produced when these tracks move over these rollers, which has for its consequence that the peripheral parts of the tracks are heated to a significant apparent temperature. These rollers are provided with a suspension having a large range of tolerance, so that they cannot be entirely hidden by side covers. For convenience, a kinematic inversion has been effected in the FIGS. 3 and 4, in accordance with which the virtual image of the detector is assumed to move, in the direction indicated by an arrow 226, between the ground 202 and a horizontal plane PH in which the line 204 is included (FIG. 1), along the lower part of the vehicle, the real movement being into the opposite direction. This movement is effected along a linear scale. For the output signal $V_{216}$ of the analog processing chain this results in curves 227 and 228, as a function of time t. These curves are constituted by the respective pulses 229 and 231, which are slightly depressed in their centres and whose interval ratios versus time t are the same as the linear interval ratios of the turning element belonging to the undercarriage of the vehicles. The curves 227 and 228 are sampled and processed in digital form, as described hereinafter with reference to FIG. 7.

The attributes suitable for use based on the curves 227 and 228 are pulses (peaks) of an amplitude which is sufficient to relate them to the same number of elements of the undercarriage. It is then possible to count the number of pulses, their widths, their intervals and to establish a comparison with types of curves representative of specific categories of vehicles.

It will be noted that the distance to the vehicle is without influence on the duration of crossing of the reference plane U. The parameters which influence this duration are the speed of the vehicle and the angle at which it shows itself relative to the plane U. On the other hand the distance plays a part, as it defines the azimuthal angle $\theta_g$ of the detection beam 203.

Figure 5:
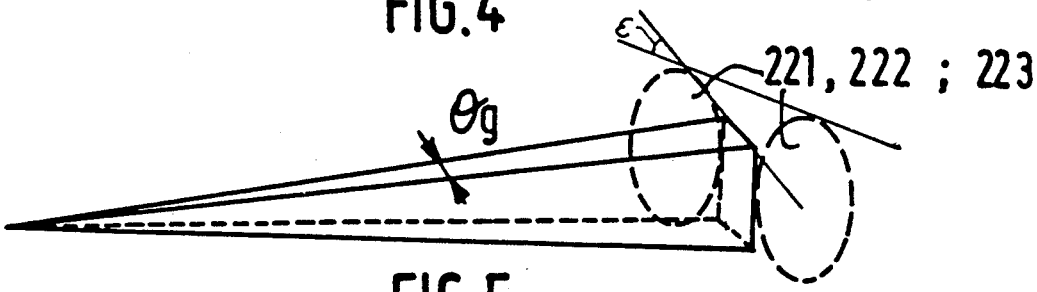
FIG. 5 illustrates how the horizontal beam aperture of a detector is determined.

For a correct analysis of the undercarriage in a range of differences ranging from some metres to some dozens of metres, the values for $\theta_g$ and $\theta_s$ or $\theta_{s/n}$ must be chosen as a function of the following criteria:

the azimuthal beam aperture (in the horizontal direction) $\theta_g$ (see FIG. 5) must be chosen such that at the maximum observation distance $D_{max}$ (i.e. the nominal distance for the case of a route to be monitored) and for all the angles at which the parts present themselves ($45° < \epsilon < 135°$), the shortest distance $D_{min}$ between adjacent turning elements of an undercarriage must be resolved by the detector or detectors. For the set of values $D_{max}=75$ m and $D_{min}=30$ cm, for example, this results in a value $\theta_g=0.2°$.

For the sight beam aperture (in the upward direction) $\theta_s$ or $\theta_{s/n}$, the calculation is based on the possibility of seeing the tyres or the rollers of a vehicle with tracks, as described in the foregoing with reference to the FIGS. 3 and 4.

Figure 6:
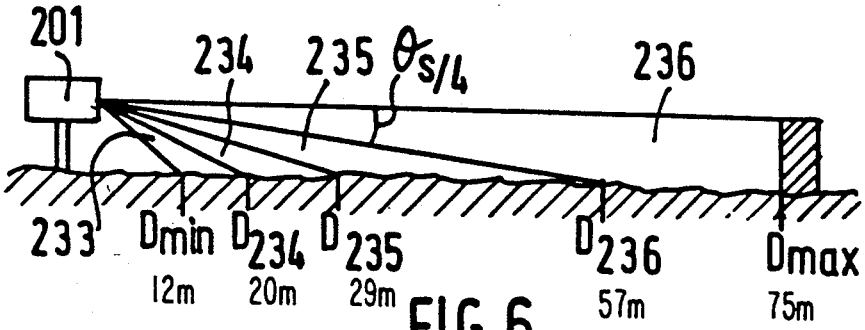
FIG. 6 represents, in a view similar to that of FIG. 1, the case in which several detectors are used for a detection in a window at a large distance.

If the vehicle to be identified is supposed to move over a road, a single detector 216 may be sufficient. On the other hand, for a comparatively large distance window comprised between some meters and some dozens of meters a number of n pyro-electric detectors will be used, for example 4 detectors which provide 4 contiguous detection sub-beams 233, 234, 235, 236 having an angle of sight $\theta_{s/4}$ as shown in FIG. 6. Thus, when the vehicle is at the minimum observation distance $D_{min}$, the undercarriage occupies the vertical field of n (n=4) detectors. In contrast thereto, when the vehicle is at the maximum observation distance $D_{max}$, the undercarriage is located in the field of a single detector, the detector which corresponds to the upper sub-beam 236. Thus, it is possible to define the value of $\theta_{s/n}$. It will also be obvious that this structural design renders it possible to obtain a first indication of the distance at which a vehicle crosses the reference plane. For example in FIG. 6, when 4 detectors are used for the detection, the vehicle is situated between 12 and 20 m from the device 201; when 3 detectors are used between 20 and 29 m; when 2 detectors are used between 29 and 57 m and when 1 detector is used between 57 and 75 m.

Figure 7:
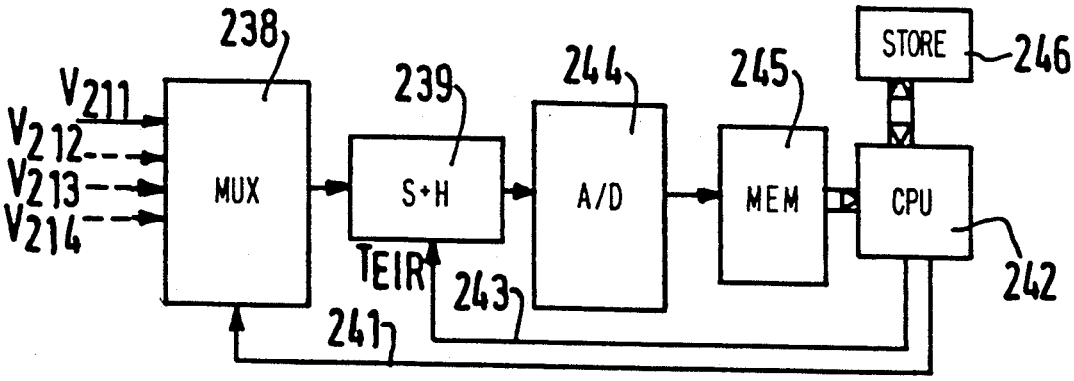
FIG. 7 is a block diagram of the second digital processing chain.

To utilize the output signals of the detector 216, the digital signal processing chain of FIG. 7 is preferably used. FIG. 7 is suitable for the case in which a plurality of detectors is used in which the signals $V_{211}$ to $V_{214}$ are applied to a multiplexer 238 followed by a sample-and-hold circuit 329. The multiplexer 238 has for its object to bring the signals $V_{211}$ to $V_{214}$ sequentially to a unique encoding path. The control signal on a conductor 241 of the multiplexer originates from a data managment processor 242 which supervises the mode of operation of the whole device. When there is only one single detector, the signal $V_{216}$, which is a single signal, is applied directly to the sample-and-hold circuit 239 which, under the control of a sampling signal of frequency $f_{EIR}$ on a conductor 243 originating from the processor 242, takes the analog value of the signal (or signals) $V_{216}$. The digital processing circuit of FIG. 7 includes inter alia an analog-to-digital converter 244 and a memory 245 for storing the digital values of the samples. The data processing circuit constituted by the processor 242 and its associated program store 246 utilizes the digital filtered signals and the recovery algorithms of the characteristic attributes of the vehicle. The sampling period $T_{EIR}$ of the signals at 239 must be calculated such that it is shorter than the duration of a pulse 229 or 231. $T_{EIR}$ can be determined from the resolution at the desired minimum distance rh to the vehicle, irrespective of its angle of view $\epsilon$ in a range of predetermined values and the value of the maximum apparent speed $V_{max}$ of the vehicle. The value of $T_{EIR}$ can then be derived from the equation:

$$T_{EIR} = \frac{rh}{v_{max}}$$

For a more complicated detection system incorporating further sensors, it may happen that the distance D of the vehicle as well as its apparent angular speed $d\gamma/dt$ are known: in that case it is obtained that:

$$T_{EIR} = \frac{rh}{D\left(\frac{d\gamma}{dt}\right)}$$

This last calculation method renders it possible to act such that the number of samples taken at a vehicle of a fixed length is the same irrespective of the distance at which it passes.

It has been shown that classification of the vehicles to be identified is effected on the basis of a search for characteristic attributes of the undercarriage. This is performed by applying a given number of digital processing operations on the samples contained in the memory 245 and, more specifically, the comparison of these samples with one or several thresholds, by means of which it is possible to identify the pulses 229 and 231. Before applying this processing operations, it is possible to take account of the distance at which a vehicle passes, acting in the following manner:

if this distance of passage is small, the attributes searched in the region of the sub-carriage will not appear at the level of each signal $V_{211}$, $V_{212}$, $V_{213}$, $V_{214}$ but from their sum (the 4 detectors cover the undercarriage).

proportionally to the increase of the distance of passage, the attributes searched for will only appear on the sum of three signals, thereafter of two signals and finally of only one signal.

The data management processor 242 is, for example, a microprocessor 6809 for Motorola and the algorithms necessary to program it to implement the invention are within the grasp of a person skilled in the art, in this case the average data processing specialist.

It should be noted that the optical section of the device can be realised in the transmission mode by means of optical elements made of germanium, for example, or in the reflection mode using a reflecting concave mirror formed by a moulded form of a plastics material coated with a metal layer.

What is claimed is:

1. An arrangement for detecting and identifying a land vehicle having an undercarriage with turning elements as it passes a reference plane comprising:

a plurality of n pyro-electric detectors for detecting passive infrared radiation which are arranged vertically and adjacent to each other in such manner so as to define in the reference plane n adjacent detection sub-beams having respective sight angles $\theta_{s/n}$ of the order of a few degrees, the sight angle $\theta_s$ of said beam being taken in a direction towards the ground from a horizontal line of the reference plane at a height of approximately 1 meter;

an optical system for focusing said sub-beams in said reference plane;

each of said pyro-electric detectors being connected to an analog processing chain including amplifier means and a band-pass filter;

a digital signal processing chain connected to said analog chain which includes sample-and-hold means to recover at least the undercarriage of said vehicle in the form of a curve as a function of time in accordance with which each turning element of the undercarriage assumes the shape of and identifiable characteristic pulse, and means for detecting the number of pyro-electric detectors that are supplying a signal to indicate the distance of the vehicle from the detector.

2. An arrangement for detecting and identifying a land vehicle as claimed in claim 1, characterized in that said digital signal processing claim includes a microprocessor.

3. An arrangement for detecting and identifying a land vehicle as claimed in claim 1 or 2, characterized in that the assembly formed by said detectors and said first analog processing chain has a passband comprised between approximately 0.5 Hertz and approximately 50 Hertz and that said assembly plus said optical system has an equivalent-noise temperature difference less than 1K.

4. An arrangement for detecting and identifying land vehicle as claimed in claim 1 characterized in that at the maximum anticipated observation distance and for all the anticipated angles at which said vehicle present themselves relative to said reference plane, the azimuthal beam aperture of said passive infrared radiation beam is such that the distance between two adjacent turning elements of the undercarriage is resolved by each detector.

* * * * *